US006732729B2

(12) United States Patent
Yeung

(10) Patent No.: US 6,732,729 B2
(45) Date of Patent: May 11, 2004

(54) RANGE HOOD WITH GREASE COLLECTING MOTOR HOUSING

(76) Inventor: Peter Yeung, 4446 Francis Street, Burnaby, British Columbia (CA), V5Z 2R4

( * ) Notice: Subject to any disclaimer, the term of this patent is extended or adjusted under 35 U.S.C. 154(b) by 149 days.

(21) Appl. No.: 10/035,116

(22) Filed: Jan. 4, 2002

(65) Prior Publication Data

US 2003/0056784 A1 Mar. 27, 2003

(51) Int. Cl.[7] ..... F24C 15/20

(52) U.S. Cl. ..... 126/299 D; 126/299 R; 55/DIG. 36

(58) Field of Search ..... 126/299 R, 299 D; 415/169.2; 454/41; 55/DIG. 36

(56) References Cited

U.S. PATENT DOCUMENTS

| | | | | |
|---|---|---|---|---|
| 2,793,712 A | * | 5/1957 | Graswich et al. | 55/404 |
| 3,286,445 A | | 11/1966 | Welch | |
| 3,589,266 A | | 6/1971 | Hike et al. | |
| 3,732,802 A | | 5/1973 | Kristof | |
| 3,834,295 A | | 9/1974 | Seidel | |
| 4,089,328 A | | 5/1978 | Bergmark et al. | |
| 4,500,331 A | | 2/1985 | Cheng | |
| 5,027,790 A | | 7/1991 | Chern | |
| 5,158,429 A | * | 10/1992 | Chiang et al. | 415/121.3 |
| 5,228,428 A | | 7/1993 | Jang | |
| 5,230,327 A | | 7/1993 | Jang et al. | |
| 5,268,012 A | * | 12/1993 | Jang | 55/471 |
| 5,311,857 A | | 5/1994 | Chang | |
| 5,323,762 A | * | 6/1994 | Chiang et al. | 126/299 E |
| 5,372,122 A | * | 12/1994 | Hong et al. | 126/299 R |
| 5,469,837 A | * | 11/1995 | Chiang et al. | 126/299 D |
| 5,537,988 A | | 7/1996 | Lin | |
| 5,628,289 A | | 5/1997 | Chang | |
| 5,809,993 A | | 9/1998 | Neitzel et al. | |
| 5,979,436 A | | 11/1999 | Chiang et al. | |
| 6,216,686 B1 | | 4/2001 | Chiu | |
| 6,267,112 B1 | | 7/2001 | Chiang | |
| 6,283,117 B1 | * | 9/2001 | Chiang | 126/299 R |

FOREIGN PATENT DOCUMENTS

| | | | |
|---|---|---|---|
| FR | 2279484 | * | 2/1976 |

* cited by examiner

*Primary Examiner*—Carl D. Price
(74) *Attorney, Agent, or Firm*—Paul Smith Intellectual Property Law; Paul Smith

(57) ABSTRACT

A range hood having a grease collecting motor housing and integrated grease tray and fan grill. The motor housing intake openings are defined by circular walls projecting vertically into the motor housing that act to prevent grease from passing back through the air intakes. Condensed liquids within the housing are directed to drain holes in the lower surface of the housing for transport out of the range hood. The tray (with attached grill) is releasable connectable to the housing through the air inlet in the range hood lower panel. The tray may be removed without removal of the lower panel of the range hood.

23 Claims, 7 Drawing Sheets

RANGE HOOD WITH GREASE COLLECTING MOTOR HOUSING

FIELD OF THE INVENTION

This invention relates to range hoods, and more particularly to the collection and disposal of grease accumulated within, and to access to, the motor housing.

BACKGROUND OF THE INVENTION

Range hoods are used above cooking surfaces to remove grease, common odors and hazardous gases created during the cooking process. Typically, range hoods have a pair of motors horizontally installed in a motor housing within the hood body. Each motor drives a fan. The fans suck air from the cooking area below and force it through the motor housing to ventilation piping.

As the vaporized grease contained in the entrained air travels through the motor housing, some of it condenses on the inside walls of the housing from where the shaping of the walls and floor of the housing directs the grease to a circular grease catcher mounted below each fan opening. Grease catchers are known in the art as illustrated in U.S. Pat. Nos. 6,216,686 B1 and 5,537,988.

Grease catchers are also adapted to capture any grease that drips off the fan blades when the motors are turned off. Typically, the grease catcher has radial inner and outer trays with a wall separating them. The wall extends vertically so as to be almost flush with the lower edge of the outer circumference of the fan. In this way air being drawn in by the fans is compelled to enter the motor housing rather than the hood body. The wall therefore acts to control the air currents of the range hood.

The grease catchers are usually provided with an inclined base or floor, so as to direct accumulated grease to a hole in the floor. A hose is attached to the hole to convey the grease to a grease receptacle outside the range hood.

The motor housing and grease catchers are mounted within the hood body. Openings in the lower surface of the hood body are positioned so as to match those of the motor housing. Typically the lower surface of the hood body is removably fitted into the main hood body. A protective grill is attached to the outside of each opening in the hood body so as to prevent the insertion of body parts when the fan is in operation.

One disadvantage of the foregoing system of motor housing and grease catchers is that in order to clean the interior of the range hood, a user must first remove the lower surface of the hood body, following which the grease catcher must then be removed. This can be quite awkward and is difficult for those without the strength to hold the weight of the lower surface.

Furthermore, because the grease catchers extend below the motor housing, the size of the hood body must be sufficient to accommodate them. The cost of materials for the production of the range hood is therefore high. The resulting range hood also takes up a large amount of space, both when installed, and when being stored or shipped, such that storage and shipping costs are high.

Furthermore, in order to increase the suction power of the range hood either the size of the fan must be increased or its speed of rotation. Both changes have undesirable consequences. To increase the size of the fan, the range hood would also have to increase in size, leading to the deficiencies outlined above. Increased rotation would cause increased noise, which is not desirable.

It is therefore an object of an embodiment of the present invention to provide a range hood in which the grease is captured within the confines of the motor housing such that the size of the range hood may be decreased in relation to a range hood with the grease catcher of the prior art.

It is a further object of the present invention to provide a range hood in which the lower surface need not be removed in order to clean the inside of the motor housing.

It is a further object of an embodiment of the present invention to provide a range hood, which has increased suction power over prior art range hoods of the same size.

It is a further object of an embodiment of the present invention to provide a range hood that has the same suction power as similar sized range hoods according to the prior art, but that produces less noise.

Various aspects of the invention address these objects, but not all aspects of the invention necessarily address all such objects simultaneously. Other objects of the invention will be apparent from the description that follows.

SUMMARY OF THE INVENTION

The invention is directed to a motor housing and tray assembly for use in a range hood. According to the invention, the motor housing acts as a grease catcher. Intake openings in the lower surface of the housing are formed by walls that project into the interior of the housing. An extension extends from the wall into the opening and in a downward direction so as to form a gap between the extension and the wall. The housing is shaped so as to direct any accumulated liquid within the housing, such as grease, towards a drainage hole in the lower surface of the housing where the liquid is directed out of the range hood. The walls prevent any liquid from passing back through the opening.

A tray, defined by inner and outer walls, is shaped so that its outer wall may be inserted into the gap in the housing. The tray may have a fan grill attached to it to prevent any body parts from being inserted into any fan operating within the housing. The tray may be releasably connected to the housing by insertion through air inlets in the lower panel of the range hood body. An automatic shutoff switch acts to shut off power to the fans when a tray is disconnected from the housing. The removable lower panel need not be removed in order to remove the tray and clean the interior of the housing.

Alternatively, the fan grill may be attached to the air inlet in the lower panel of the hood body. In this embodiment, the lower panel must be removed in order to releasably connect the tray to the housing.

In one aspect, the invention comprises a motor housing and tray assembly for a range hood where the motor housing generally defines an enclosure and comprises an upper surface and a lower surface. The lower surface has at least one intake opening and at least one drain hole. The intake opening is defined by a wall depending from the lower surface and projecting into the interior of the enclosure. The tray comprises an opening, first and second tray walls extending around the opening, and a floor between the first and second tray walls. The tray is releasably connectable to the intake opening.

Alternative embodiments of the motor housing and tray assembly for a range hood comprise one or more of the following:

a. the wall of the intake opening of the motor housing of the invention has an extension extending toward the intake opening so as to define a gap between the extension and the wall of the intake opening;

b. at least a portion of the extension diverges from the wall of the intake opening to form a wedge surface;

c. the tray is releasably connectable to the intake opening by wedging the second tray wall into the gap;

d. the first tray wall is proximal to the tray opening and the second tray wall is distal from the tray opening in relation to the first tray wall. The second tray wall is shaped and dimensioned so as to be insertable within the intake opening so that at least a portion of the second tray wall is in abutment with at least a portion of the wall of the intake opening, forming a close fit;

e. a grill is connected to the first wall of the tray of the assembly;

f. the tray has a bottom surface, and when the second wall is inserted in the gap, at least a portion of the bottom surface of the tray lies in substantially the same plane as the lower surface; and g. there are two intake openings, two trays and two drain holes.

In another embodiment, the assembly according to the invention comprises a range hood, motor housing and tray. The range hood generally defines an enclosure and comprises an upper panel and a lower panel. The lower panel has at least one air inlet. The motor housing is connectable to the range hood within the enclosure of the range hood, the motor housing generally defining a further enclosure and comprising an upper surface and a lower surface. The lower surface has at least one intake opening and at least one drain hole. A wall depending from the lower surface and projecting into the interior of the further enclosure defines the intake opening. The tray comprises an opening, a first tray wall extending around and proximal to the tray opening, a second tray wall distal from the tray opening in relation to the first tray wall, and a floor between the first and second tray walls. The second tray wall is shaped and dimensioned so as to be insertable within the gap, forming a close fit. Finally, the tray is releasably connectable to the intake opening.

Further aspects of alternative embodiments of the range hood, housing and tray assembly may comprise one or more of the following:

a. the air inlet is defined by a second wall depending from the lower panel and projecting into the interior of the range hood enclosure;

b. the air inlet and the intake opening are of identical shape, the air inlet being located directly below the intake opening;

c. the tray may be releasably inserted into the air inlet and connected to the intake opening;

d. a grill is connected to the first tray wall;

e. the housing is shaped so as to direct any liquid located within it to the drain hole; and f. there are two intake openings, two air inlets, two trays and two drain holes.

Other aspects of the invention will be appreciated by reference to the detailed description of the preferred embodiment and to the claims that follow.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
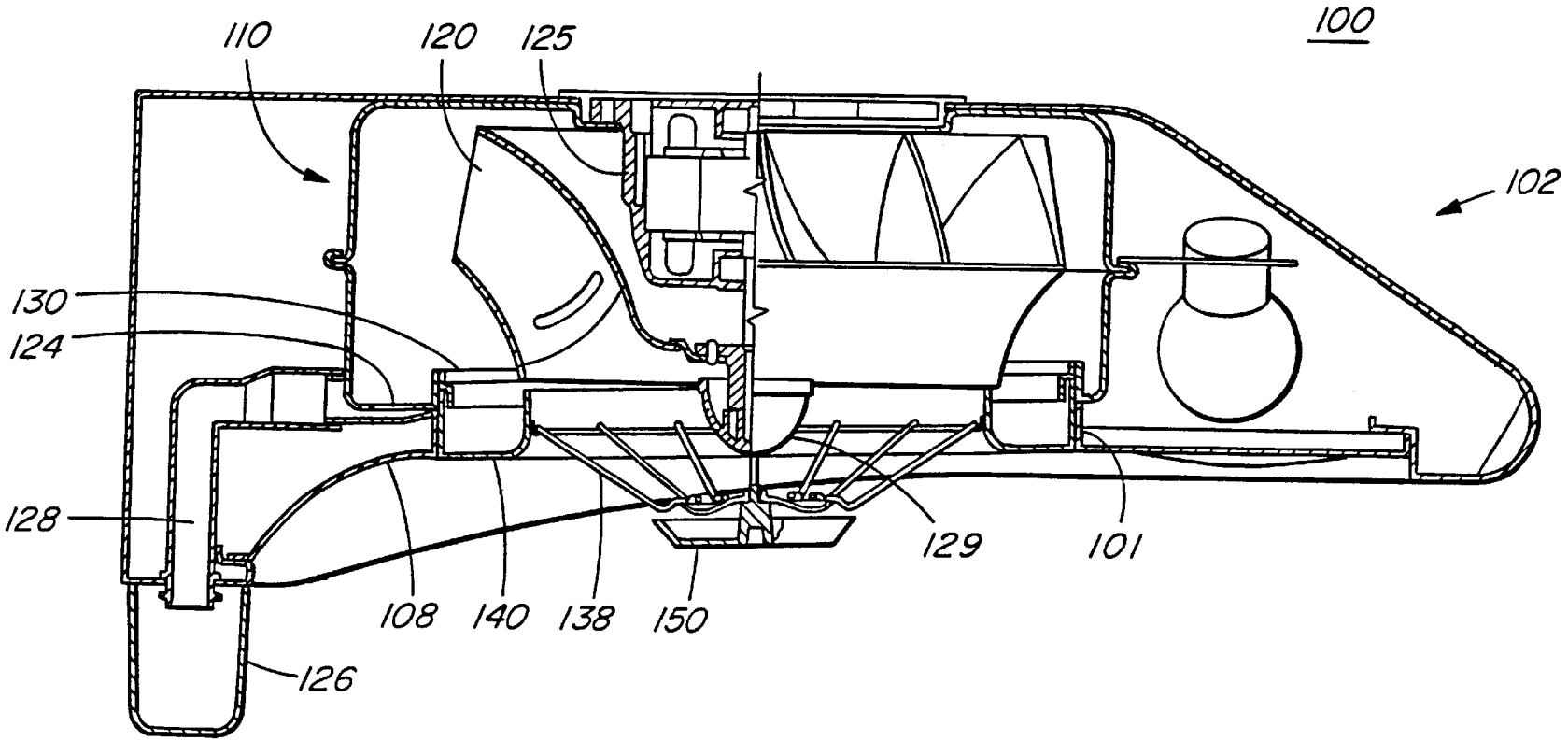
FIG. 1 is a cross sectional view of a range hood according to the preferred embodiment of the invention.

The preferred embodiment of a range hood 100 with a motor housing and tray according to the invention is illustrated in FIG. 1. The motor housing 110 itself doubles as a grease catcher. Tray 140, which has an integral fan grill 138, is releasably connectable to both the motor housing 110 and to lower panel 108 of the hood body 102 as discussed below. Both the housing 110 and the tray 140 will be described in greater detail below.

The housing 110 defines an enclosure and is mountable within the enclosure formed by the hood body generally indicated by the numeral 102. A pair of motors 125 fit within the motor housing 110 and are attached to the upper surface of the hood body 102. Fans 120 are attached to each of the motors 125 and secured by fan caps 129. The motors 125 are positioned within the motor housing so that when the fans 125 are attached they are positioned above intake openings 112 (of the motor housing 110) and air inlets 109 (of the lower panel 108), shown in FIGS. 2 and 4. When activated, the motors 125 act to rotate the fans such that air is drawn through intake openings 112 and air inlets 109 and into the motor housing 110. Air drawn into the motor housing is then forced out of ventilation holes in the upper surfaces of the housing 110 and hood body 102.

The fans 120 and motors 125 are dimensioned so as to be removable from within the housing 110 through openings 112.

Figure 3:
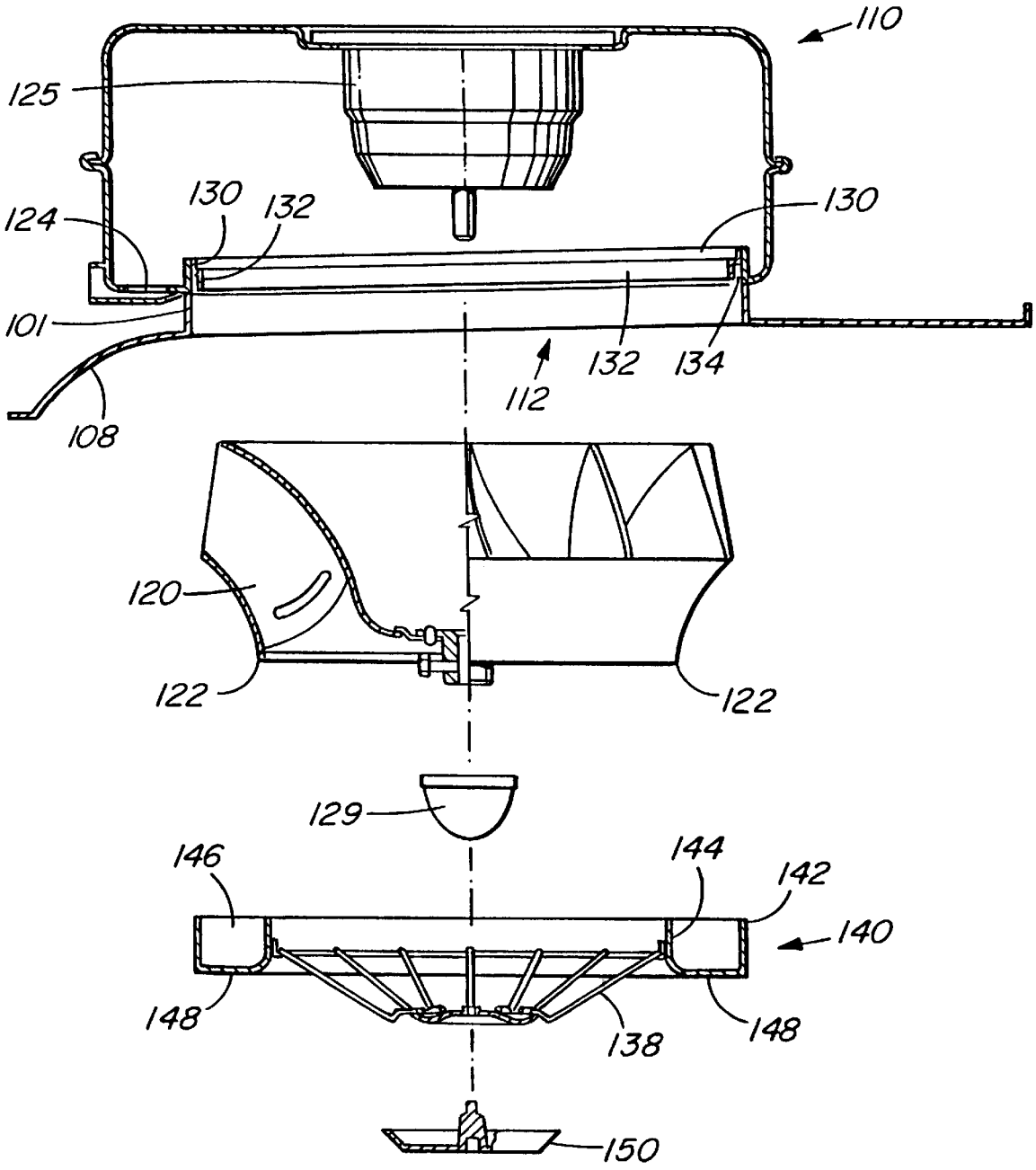
FIG. 3 is an exploded cross sectional view of portions of the range hood of FIG. 1.
Figure 4:
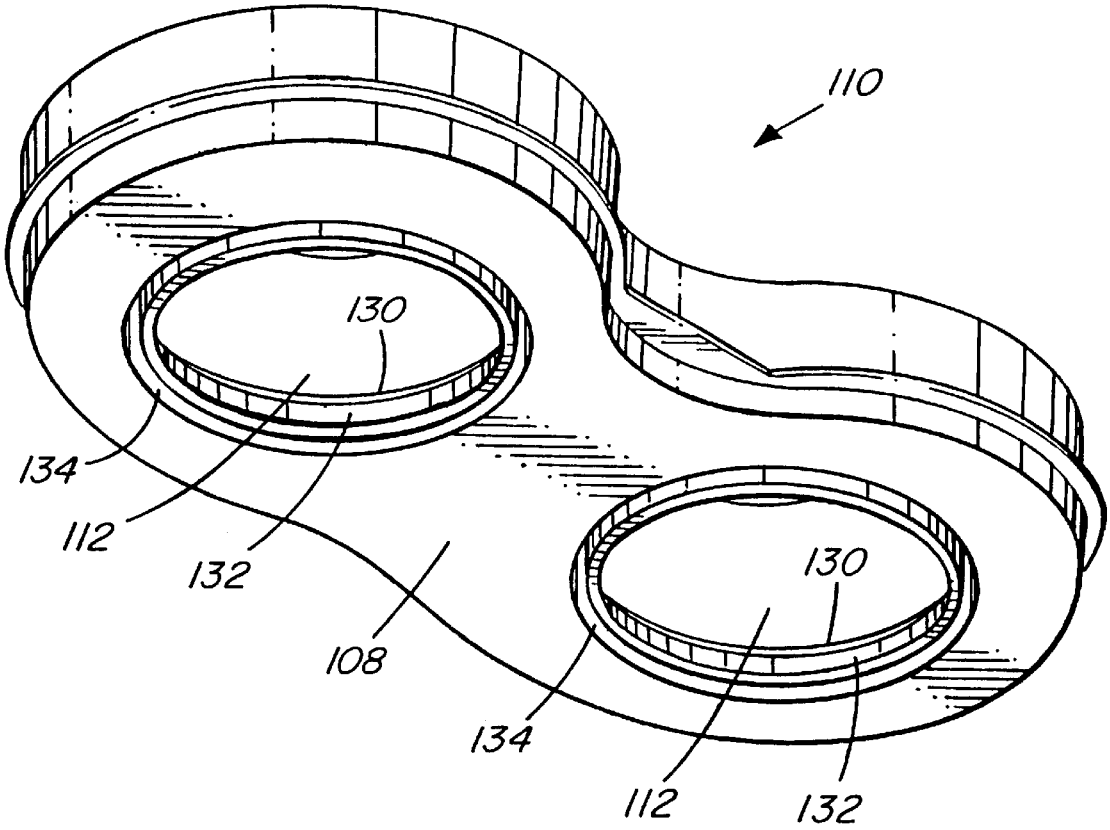
FIG. 4 is a perspective view of a motor housing according to the preferred embodiment of the invention.

As shown in FIG. 4, openings 112 in motor housing 110 have walls 130 depending and rising vertically from lower surface 108. The diameter of the circles formed by walls 130 is roughly equal to the diameter of the intake openings 109. An outwardly and downwardly projecting extension or lip 132 depends from wall 130, so as to form a gap 134 between the lip 132 and wall 130, as illustrated in FIG. 3. Extension 132 may diverge from wall 130 such that gap 134 forms a wedge surface.

Figure 5:
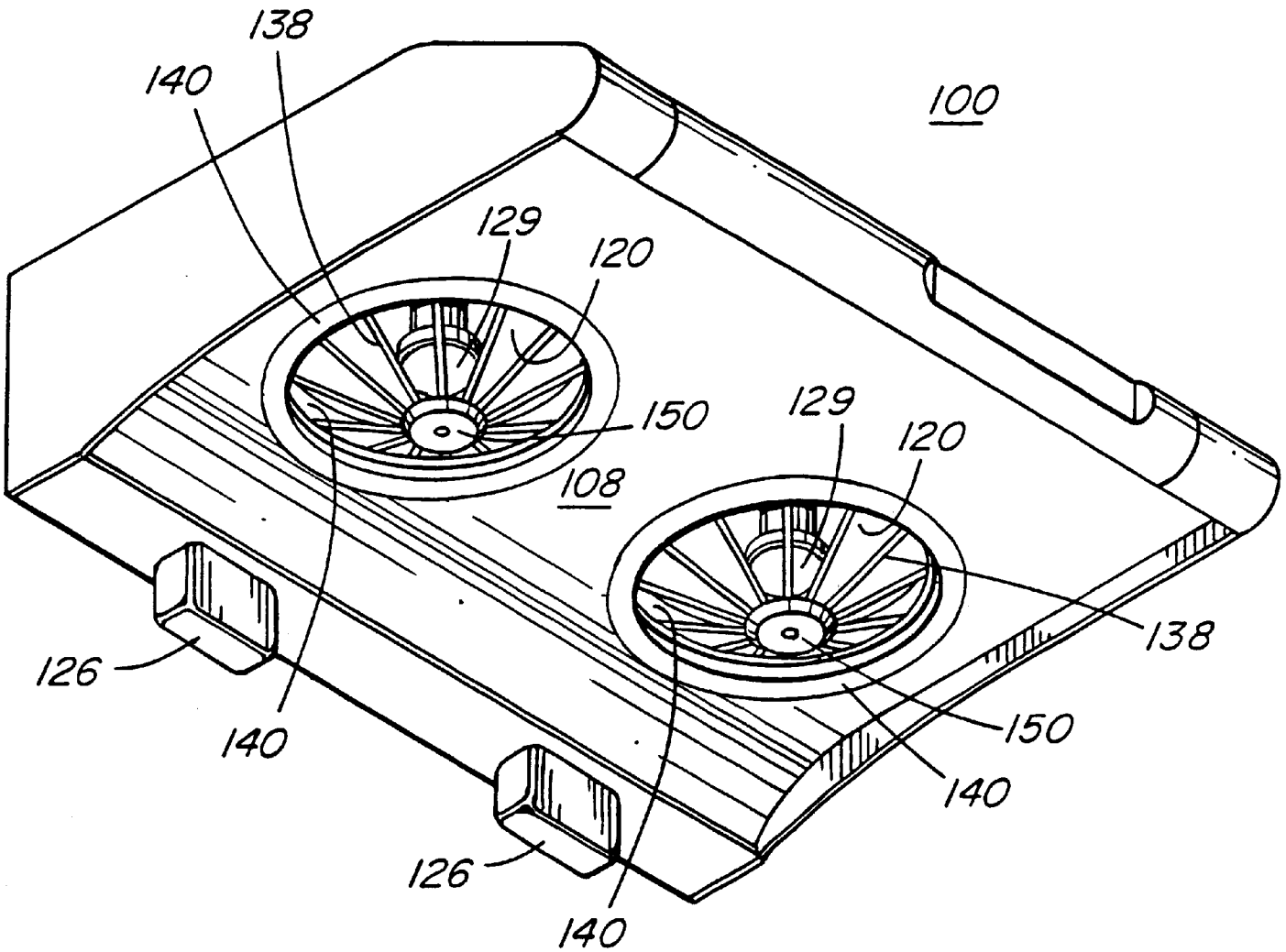
FIG. 5 is a perspective view of the range hood of FIG. 1 in its assembled form.

Fan grills 138, illustrated in FIG. 5, are preferably made of metal and are designed to allow maximum airflow into motor housing 110, while still preventing solid objects such as kitchen utensils or body parts from penetrating through the grill to fans 120.

The tray 140 is circular and has inner wall 144, concentric outer wall 142, trough 146 and fan grill 138, which is connected to inner wall 144. Inner wall 144 is proximate to, and defines, an opening. Outer wall 142 is distal from the opening in relation to the inner wall 144. Outer wall 142 is shaped and dimensioned to fit within gap 134 when tray 140 is connected with housing 110 so that a portion of outer wall 142 is in abutment with wall 130. Preferably, the diameter of inner wall 144 is smaller than the diameter of lower fan edge 122. The tray 140 is dimensioned such that when connected with the motor housing 140, the top of inner wall 144 is just below the level of fan 120, thereby directing air into the housing 110 by way of the fan 120.

Figure 2:
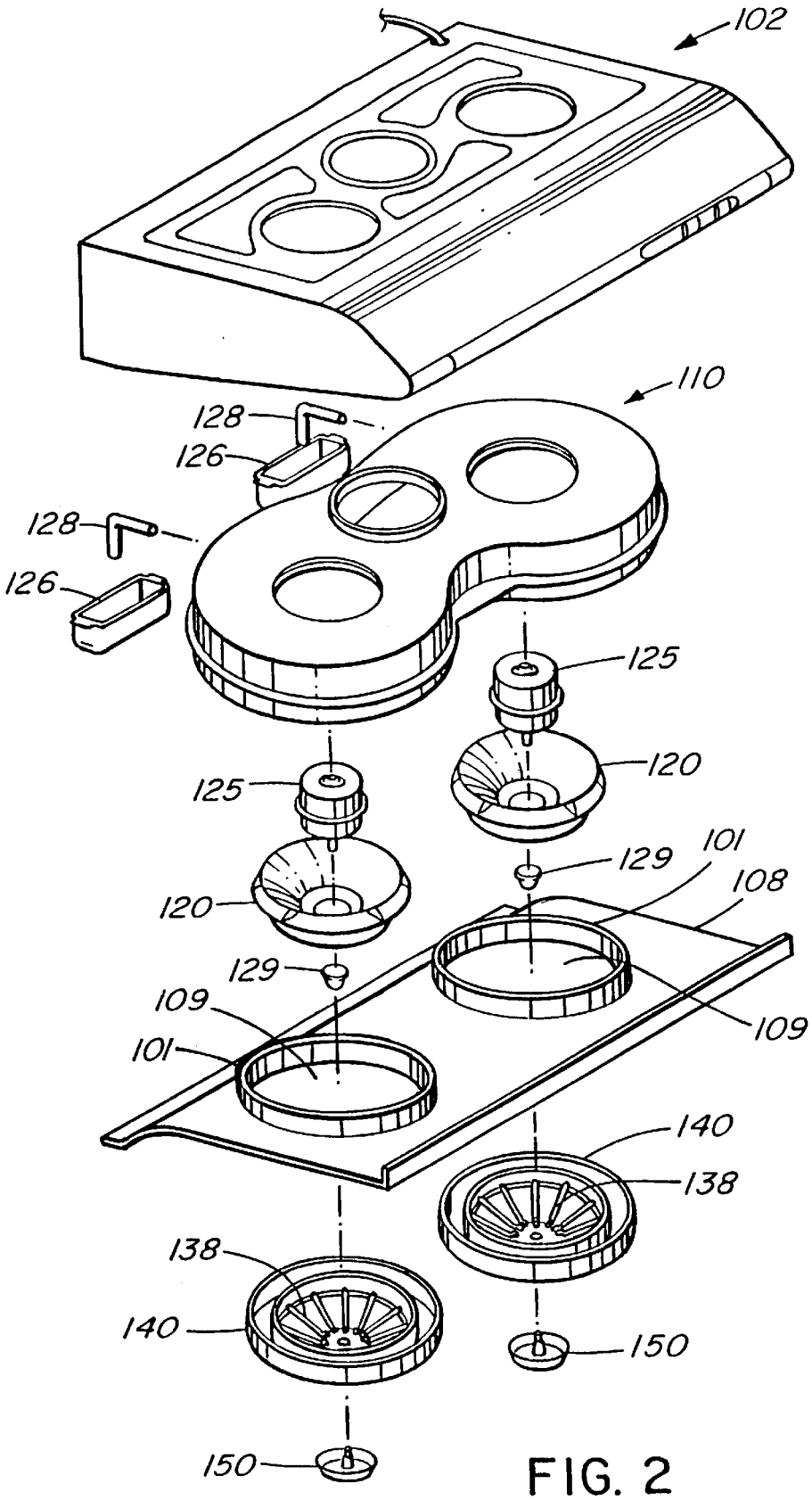
FIG. 2 is an exploded perspective view of the range hood of FIG. 1.

The lower panel 108 is removable from the remainder of main hood body 102, as discussed in greater detail below. Lower panel 108 has a pair of air inlets 109 as shown in FIG. 2. Air inlets 109 are defined by circular vertical walls 101, which depend, and rise vertically from, lower surface 108. The circular vertical walls 101 can vary in height between a minimum height and a maximum height. The minimum height is the height at which the circular vertical walls 101 will remain in contact with the tray 140 when it is connected to the housing 110 as described below. The maximum height is the height at which the top of the circular vertical walls 101 abuts the bottom of the housing 110 when the lower panel 108 is connected with hood body 102.

Tray 140 is connected to the range hood 100 by inserting it through intake opening 109 in lower panel 108 and into intake opening 112 in the motor housing 110 until outer wall 142 is firmly in place within gap 134. Tray 140 may be releasably connected to housing 110 by wedging outer wall 142 into gap 134. Preferably, when tray 140 is connected to the housing 110, outer wall 142 is also in contact with lower panel 108 and acts to seal any space that may exist between the housing and the lower panel thereby preventing air from entering into any undesired area within the range hood body 102. However, it is contemplated that if circular vertical wall 101 is dimensioned so as to abut the bottom of housing 110 so as to form a seal when lower panel 108 is connected with the hood body 102, then tray 140 may fit loosely within intake opening 109 while connected to said housing. A clip or other form of suitable restraint (not shown) accessible on the outside surface of the range hood is used to hold the tray in place. In this way, lower panel 108 need not be removed in order to access the interior of the motor housing 110. A user need simply remove the tray in order to access the interior of the housing, for example, to remove the fans 120 and clean the interior of the motor housing.

The range hood 100 is equipped with an automatic shutoff switch. Shutoff switches are known in the art and are used as a safety feature to cut off power to the motors 125 when no protective grill is in place to prevent access to the fans 120. Preferably, the shutoff switch is releasably attached to the housing 110. However, it is contemplated that the shutoff switch could be positioned elsewhere, including to lower panel 108. Any position is satisfactory provided that there is a shutoff switch for each intake opening and provided that the shutoff switch acts to cut the power to the fans when a tray and fan grill are not connected, or not properly connected, to the range hood.

Fan tip grease catcher 150 is releasably attachable to the lowest portion of the fan grill 138 and acts to catch any grease or other liquid that may drip from the lowest portion of the fan grill 138.

Motor housing 110 is shaped such that any accumulated grease or liquid that condenses on its inner surface is directed towards drain holes 124 in motor housing 110. Holes 124 are therefore located at the lowest point of lower surface 118. As seen in FIG. 1 and FIG. 3, a hose 128 is attached to each of holes 124. Accumulated grease and liquids travel through hoses 128 by way of gravity to an external grease cup 126. Wall 130 (best seen in FIG. 3) acts as a barrier to any condensed grease or other liquid which accumulates in the interior of the motor housing, preventing it from dripping through opening 112. Typically only a very small amount of grease drips from a fan 120 as most is dispersed by means of the centripetal force of the rotating fan. Any grease or liquid that does drip from the fan when it is no longer rotating tends to drip from lower fan edge 122 and is captured in trough 146. As very little grease accumulates in trough 146, it need only be cleaned periodically during regular maintenance of the range hood and need only have minimal depth.

By altering the motor housing so that it acts as a grease catcher itself, the need for the large grease catchers of the prior art is negated and the overall size of the range hood in comparison to those of the prior art may be decreased. This more streamlined range hood is able to intake the same cubic feet per minute (cfm) of air of a larger range hood while taking up less space. Additionally, a smaller size translates into lower material costs in the construction of the range hood and additional savings in shipping and storing costs.

Alternatively, if the size of the range hood is maintained, then a larger motor housing, motor and fan can be used as compared to the range hoods of the prior art, occupying space previously occupied by grease catchers of the prior art. By increasing the size of the fans, a greater intake of air may be achieved while running at the same rpm as a range hood with smaller fans. Hence a more powerful range hood may be designed without having to increase the size of the range hood. Additionally, the same cfm could be generated at lower rpm, thereby making a quieter range hood.

Figure 6:
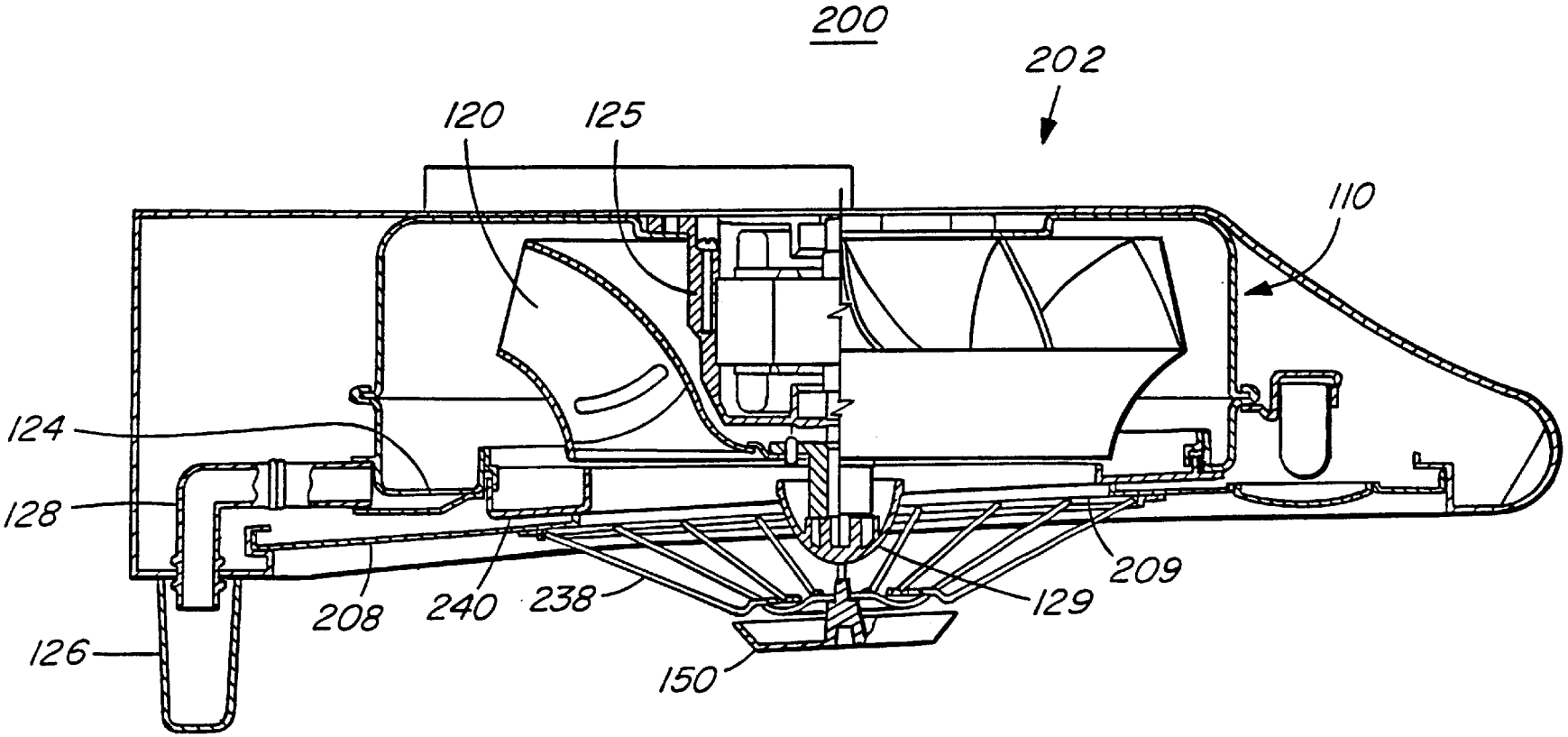
FIG. 6 is a cross sectional view of an alternative embodiment of range hood according to the invention.
Figure 7:
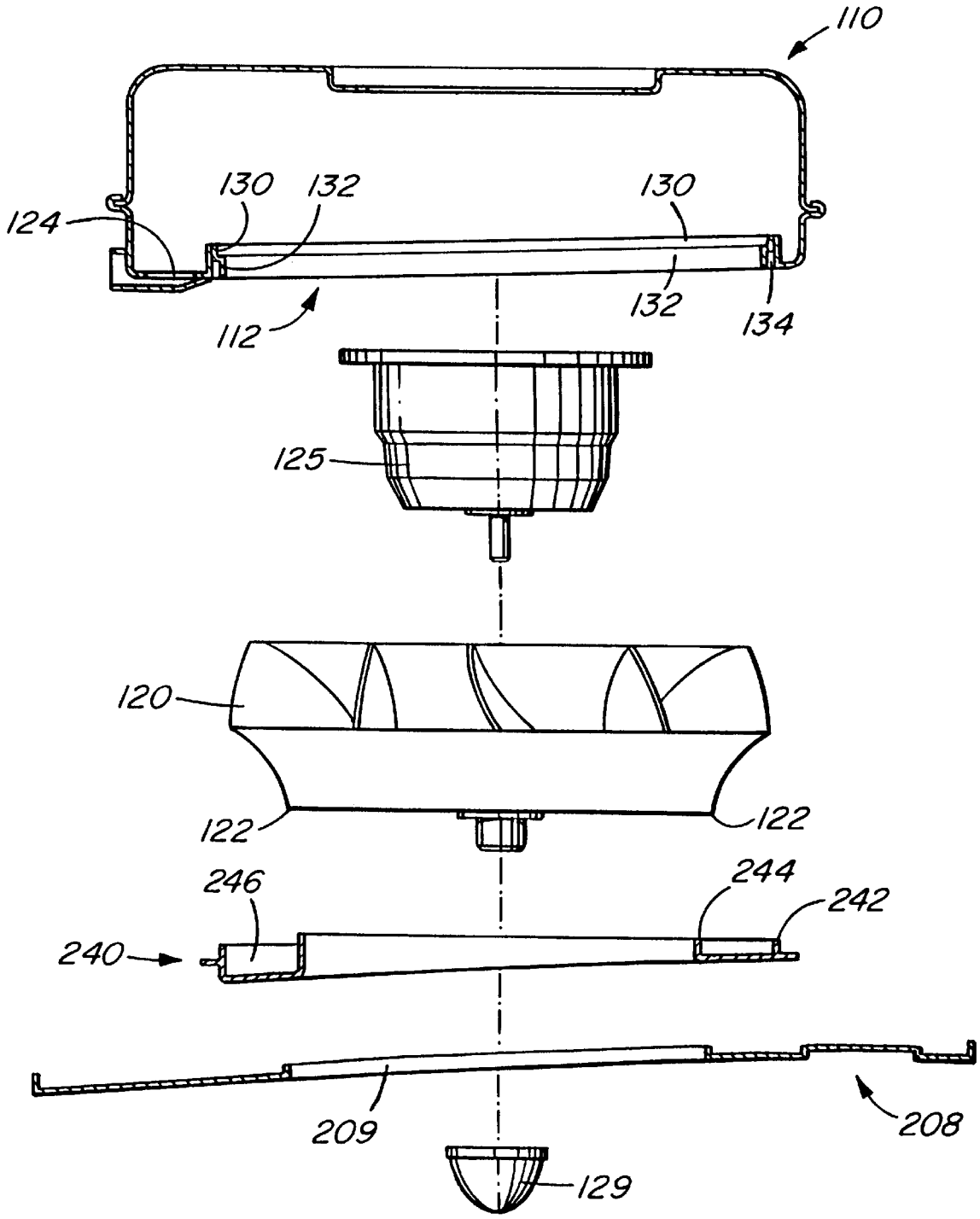
FIG. 7 is an exploded cross sectional view of portions of the range hood of FIG. 6.

An alternative embodiment of the invention is shown in FIGS. 6–7. Those aspects of the alternative embodiment that are identical to aspects of the preferred embodiment have identical reference numbers.

The lower panel 208 and the tray 240 of range hood 200 differ from those described above. In this embodiment, fan grill 238 is connected to lower panel 208. Preferably this connection is fixed such that grill 238 is not easily detached from lower panel 208. Tray 240 has outer wall 242, inner wall 244 and trough 246. Outer wall 242 fits within gap 134 when tray 240 is connected with motor housing 110. A clip or any suitable restraint (not shown) may be used to hold tray 240 in place with the motor housing 110. Tray 240 is dimensioned such that the diameter of inner wall 244 is smaller than the diameter of the lower fan edge 122. Furthermore, inner wall 244 is dimensioned such that when tray 240 is connected with motor housing 110, the top of inner wall 244 is just below the level of fan 120, thereby acting to direct the inflow of air into the motor housing 110.

Lower panel 208 is releasably connectable to hood body 202. In order to connect or remove tray 240, the lower panel 208 must first be removed. An automatic shutoff swich, as described above acts to cut off power when the lower panel 208 is disconnected from the hood body. Air inlets are defined by circular vertical walls 209, which are dimensioned so that when lower panel 208 is connected to the hood body, circular vertical walls 209 abut trays 240. This flush fit between components ensures that air is just drawn into the motor housing and does not travel into the remainder of the hood body.

It will be appreciated by those skilled in the art that the preferred and alternative embodiments have been described in some detail but that certain modifications may be practiced without departing from the principles of the invention.

What is claimed is:

1. A motor housing and tray assembly for a range hood wherein:

said motor housing generally defines an enclosure and comprises an upper surface and a lower surface, said lower surface having at least one intake opening and at least one drain hole;

said intake opening is defined by a wall depending from said lower surface and projecting into the interior of said enclosure;

said tray comprises an opening, first and second tray walls extending around said opening, and a floor between said first and second tray walls;

said tray is releasably connectable to said intake opening; and said wall of said intake opening has an extension extending toward said intake opening so as to define a gap between said extension and said wall of said intake opening.

2. The assembly of claim 1 wherein at least a portion of said extension diverges from said wall of said intake opening to form a wedge surface.

3. The assembly of claim 1 or claim 3 wherein said tray is releasably connectable to said intake opening by wedging said second tray wall into said gap.

4. A motor housing and tray assembly for a range hood wherein:

said motor housing generally defines an enclosure and comprises an upper surface and a lower surface, said lower surface having at least one intake opening and at least one drain hole;

said intake opening is defined by a wall depending from said lower surface and projecting into the interior of said enclosure;

said tray comprises an opening, first and second tray walls extending around said opening, and a floor between said first and second tray walls;

said tray is releasably connectable to said intake opening; and said first tray wall is proximal to said tray opening and said second tray wall is distal from said tray opening in relation to said first tray wall; and said second tray wall is shaped and dimensioned so as to be insertable within said intake opening such that at least a portion of said second tray wall is in abutment with at least a portion of said wall of said intake opening, forming a close fit.

5. The assembly of claim 4 wherein said wall of said intake opening has an extension extending toward said intake opening so as to define a gap between said extension and said wall of said intake opening.

6. The assembly of claim 5 wherein at least a portion of said extension diverges from said wall of said intake opening to form a wedge surface.

7. The assembly of claim 5 or claim 7 wherein said tray is releasably connectable to said intake opening by wedging said second tray wall into said gap.

8. The assembly of claim 4 wherein a grill is connected to said first wall.

9. The assembly of claim 5 wherein said tray has a bottom surface, and wherein when said second wall is inserted in said gap, at least a portion of said bottom surface of said tray lies in substantially the same plane as said lower surface.

10. The assembly of claim 5 comprising two of said intake openings, two of said trays and two of said drain holes.

11. A motor housing and tray assembly for a range hood wherein:

said motor housing generally defines an enclosure and comprises an upper surface and a lower surface, said lower surface having at least one intake opening and at least one drain hole;

said intake opening is defined by a wall depending from said lower surface and projecting into the interior of said enclosure;

said tray comprises an opening, first and second tray walls extending around said opening, and a floor between said first and second tray walls;

said tray is releasably connectable to said intake opening; and there being two of said intake openings, two of said trays and two of said drain holes.

12. A motor housing and tray assembly for a range hood wherein:

said motor housing generally defines an enclosure and comprises an upper surface and a lower surface, said lower surface having at least one intake opening and at least one drain hole;

said intake opening is defined by a wall depending from said lower surface and projecting into the interior of said enclosure, said wall having an extension extending toward said intake opening so as to define a gap between said extension and said wall of said intake opening;

said tray comprises an opening, a first tray wall extending around and proximal to said tray opening, a second tray wall distal from said tray opening in relation to said first tray wall, and a floor between said first and second tray walls;

said second tray wall is shaped and dimensioned so as to be insertable within said gap, forming a close fit; and said tray is releasably connectable to said intake opening.

13. The assembly of claim 12 wherein said housing is shaped so as to direct any liquids within said enclosure to said drain hole.

14. The assembly of claim 13 wherein a grill is connected to said first tray wall.

15. The assembly of claim 14 wherein said tray has a bottom surface, and wherein when said second tray wall is inserted in said gap, at least a portion of said bottom surface of said tray lies in substantially the same plane as said lower surface.

16. The assembly of claim 15 comprising two of said intake openings, two of said trays and two of said drain holes.

17. A range hood, motor housing and tray assembly wherein:

said range hood generally defines an enclosure and comprises an upper panel and a lower panel, said lower panel having at least one air inlet;

said motor housing is connectable to said range hood within said enclosure of said range hood, said motor housing generally defining a further enclosure and comprising an upper surface and a lower surface, said lower surface having at least one intake opening and at least one drain hole;

said intake opening is defined by a wall depending from said lower surface and projecting into the interior of said further enclosure;

said tray comprises an opening, a first tray wall extending around and proximal to said tray opening, a second tray wall distal from said tray opening in relation to said first tray wall, and a floor between said first and second tray walls;

said second tray wall is shaped and dimensioned so as to be insertable within said gap, forming a close fit; and said tray is releasably connectable to said intake opening.

18. The assembly of claim 17 wherein said air inlet is defined by a second wall depending from said lower panel and projecting into the interior of said range hood enclosure.

19. The assembly of claim 18 wherein said air inlet and said intake opening are of identical shape, said air inlet being located directly below said intake opening.

20. The assembly of claim 19 wherein said tray may be releasably inserted into said air inlet and connected to said intake opening.

21. The assembly of claim 20 wherein a grill is connected to said first tray wall.

22. The assembly of claim 21 comprising two of said intake openings, two of said air inlets, two of said trays and two of said drain holes.

23. The assembly of claim 17 wherein said housing is shaped so as to direct any liquid located within said further enclosure to said drain hole.

* * * * *

UNITED STATES PATENT AND TRADEMARK OFFICE

CERTIFICATE OF CORRECTION

PATENT NO. : 6,732,729 B2
DATED : May 11, 2004
INVENTOR(S) : Peter Yeung

It is certified that error appears in the above-identified patent and that said Letters Patent is hereby corrected as shown below:

Column 7,
Line 13, replace “claim 3” with -- claim 2 --.
Line 45, replace “claim 7” with -- claim 6 --.

Signed and Sealed this

Twenty-first Day of September, 2004

JON W. DUDAS
*Director of the United States Patent and Trademark Office*